US009824531B2

(12) United States Patent
Iyer et al.

(10) Patent No.: US 9,824,531 B2
(45) Date of Patent: Nov. 21, 2017

(54) PROGRESSIVE CONFIGURATION DEVICE, SYSTEM AND METHOD FOR GAMING DEVICES

(71) Applicant: Bally Gaming, Inc., Las Vegas, NV (US)

(72) Inventors: Sreekanth Iyer, Las Vegas, NV (US); Andrew St. Martin, Las Vegas, NV (US); Kalpesh Panara, Las Vegas, NV (US); Robert Crowder, Las Vegas, NV (US); Don Stefanich, Las Vegas, NV (US); Jason Cunningham, Las Vegas, NV (US); Tony Green, Las Vegas, NV (US); Nathan Harvey, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 351 days.

(21) Appl. No.: 13/630,657

(22) Filed: Sep. 28, 2012

(65) Prior Publication Data

US 2013/0090160 A1 Apr. 11, 2013

Related U.S. Application Data

(60) Provisional application No. 61/541,352, filed on Sep. 30, 2011.

(51) Int. Cl.
*A63F 9/24* (2006.01)
*G07F 17/32* (2006.01)

(52) U.S. Cl.
CPC ..... *G07F 17/3225* (2013.01); *G07F 17/3258* (2013.01); *G07F 17/32* (2013.01); *G07F 17/3244* (2013.01)

(58) Field of Classification Search
CPC ..... G07F 17/34; G07F 17/32; G07F 17/3244; G07F 17/3258
USPC ..... 463/25–28, 39–42; 273/138.1, 139
See application file for complete search history.

(56) References Cited

U.S. PATENT DOCUMENTS

| | | | | |
|---|---|---|---|---|
| 8,109,827 | B2 * | 2/2012 | Cahill et al. | 463/27 |
| 2005/0003880 | A1 * | 1/2005 | Englman et al. | 463/16 |
| 2005/0239542 | A1 * | 10/2005 | Olsen | G07F 17/32 463/27 |
| 2006/0052159 | A1 * | 3/2006 | Cahill et al. | 463/27 |
| 2009/0131160 | A1 * | 5/2009 | Torres | G07F 17/32 463/27 |
| 2010/0075742 | A1 * | 3/2010 | Gagner | G07F 17/323 463/20 |
| 2010/0075746 | A1 * | 3/2010 | Anderson | G07F 17/323 463/25 |
| 2010/0261521 | A1 * | 10/2010 | Oatman | G07F 17/323 463/25 |

(Continued)

*Primary Examiner* — William H McCulloch, Jr.
*Assistant Examiner* — Chase Leichliter
(74) *Attorney, Agent, or Firm* — Philip J. Anderson; Marvin A. Hein, Jr.

(57) ABSTRACT

A device, system and method are set forth which provides for auto-configuration of progressive jackpot gaming linkages. Gaming terminals may be provided with jackpot controller software modules available to be unlocked when a licensed security device is attached. The progressive jackpot controller receives game attribute data and determines which games can be associated with which mystery or symbol based progressive jackpots. Reporting and logging functions are provided as well.

6 Claims, 8 Drawing Sheets

(56) References Cited

U.S. PATENT DOCUMENTS

| | | | | |
|---|---|---|---|---|
| 2010/0298040 | A1* | 11/2010 | Joshi et al. | 463/16 |
| 2011/0014971 | A1* | 1/2011 | Ward | G07F 17/32 463/25 |
| 2012/0004027 | A1* | 1/2012 | Larsen | G07F 17/3258 463/27 |

* cited by examiner

PROGRESSIVE CONFIGURATION DEVICE, SYSTEM AND METHOD FOR GAMING DEVICES

CROSS REFERENCE TO RELATED APPLICATION

This application is a non-provisional filing from and claims priority to U.S. Provisional Application Ser. No. 61/541,352 filed Sep. 30, 2011 and titled "Progressive Configuration Device, System and Method for Gaming Devices.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The invention relates to devices, methods and systems for connecting gaming devices to progressive jackpots. More particularly it is directed to such devices, systems and methods which simplify and secure such progressive connections.

BACKGROUND

In gaming, the use of progressives has been known as a way to stimulate interest for players inasmuch as large jackpots can be created. In a most basic form, a progressive includes a controller which is in communication with a number of gaming machines. The gaming machines may be in the same bank, in the same casino or in casinos across the country. The best known example is the "Megabucks®" multisite progressive offered by IGT of Reno, Nev. The "Megabucks®" setup includes stepper-type slot machines or video slot machines linked so that a percentage of each qualifying wager (usually a maximum bet is required) contributes to the progressive prize as well as toward the start-up or seed value for the next prize. The prize is won when a machine in the link displays the winning jackpot symbols as required. When the progressive prize is awarded, the progressive prize is re-set back to a start or seed value and the progressive accumulation begins anew.

The connection of gaming machines to a progressive requires a technician to connect or link the gaming machines. In most cases the gaming machines are similarly configured although their theme may be different. That is, the machines for the progressive links are clones with regards to their odds-to-jackpot and denomination. It has been known to connect different games to a common progressive such as disclosed in Tracy, U.S. Pat. No. 5,116,055 filed Jul. 2, 1991, issued May 26, 1992 and titled "Progressive Jackpot Gaming System Linking Gaming Machines With Different Hit Frequencies and Denominations" the disclosure of which is incorporated by reference. In Tracy '055 a symbol combination is required to trigger the jackpot. Such systems and Megabucks® as well are often referred to as symbol-based progressives since the player must obtain the winning symbol combination.

Mystery progressives are known as well. Once such arrangement is disclosed in Acres et al U.S. Pat. No. 5,655,961 the disclosure of which is incorporated by reference. In this patent the progressive is awarded not based upon symbol combination but upon the bonus pool reaching a "turn-on" level. Hence the award to a player is a mystery.

A drawback of prior progressives is that the connection of the gaming machines requires the technician to correctly configure the gaming machines and their link. Incorrect configuration by connecting a gaming machine having incompatible operational characteristics can mean that a particular gaming machine will have greater odds of hitting the jackpot than others, that a particular gaming machine will not share in building the progressive prize as designed, e.g. too little or too great of a contribution or that a particular gaming machine may be more or less likely to win a mystery. It has been known to mis-configure a link resulting in a loss to the casino or the player.

It would be advantageous to provide a device. System and method where configuration is to a degree fool proof for the technician.

It would also be advantageous to provide a level of security required before a technician can attempt to configure a progressive link between gaming machines to avoid improper configurations or detect unauthorized alterations in the link.

SUMMARY OF THE INVENTION

In accordance with one aspect of the invention/s, there is set forth a device, system and method for operating progressive jackpots which includes a jackpot controller configured to support one or more progressive jackpots. In a preferred embodiment one or more gaming machines, for example in a bank of gaming machines, are configured to be designated as the jackpot controller. The controller is programmed to define the parameters for one or more progressive jackpots such as the denomination, odds to jackpot, money to jackpot and denomination which may be supported by each progressive. The controller is programmed to broadcast over a network to compatible gaming machines a request for them to respond with data corresponding to the games and associated attributes which are supported by the gaming machines. For example, each gaming machine may support of a number of wagering games having different attributes such as pay tables, odds to jackpot, money to jackpot and wagering denomination. The gaming machines respond by providing the data to the controller which determines which games are compatible with which progressive jackpots. In one embodiment the controller can automatically make the association to connect the compatible game to its associated progressive jackpot. In another embodiment, the controller is configured to display at a display which games are supported for which progressive jackpots. A technician, by making the appropriate selection, links the compatible games to the appropriate progressive jackpot(s).

In a preferred embodiment a portable security device such as a USB memory device programmed to cooperate with the game processor is connected to the game processor of one of the gaming machines to configure the gaming machine into also acting as the progressive controller. The device may include require cryptographic authentication between itself and the gaming machine to confirm the designation of the gaming machine as the progressive controller.

BRIEF DESCRIPTION OF THE DRAWINGS

These and other features and advantages will become better understood with reference to the specification claims and drawings wherein;

DETAILED DESCRIPTION

A. Gaming Terminal

Figure 1:
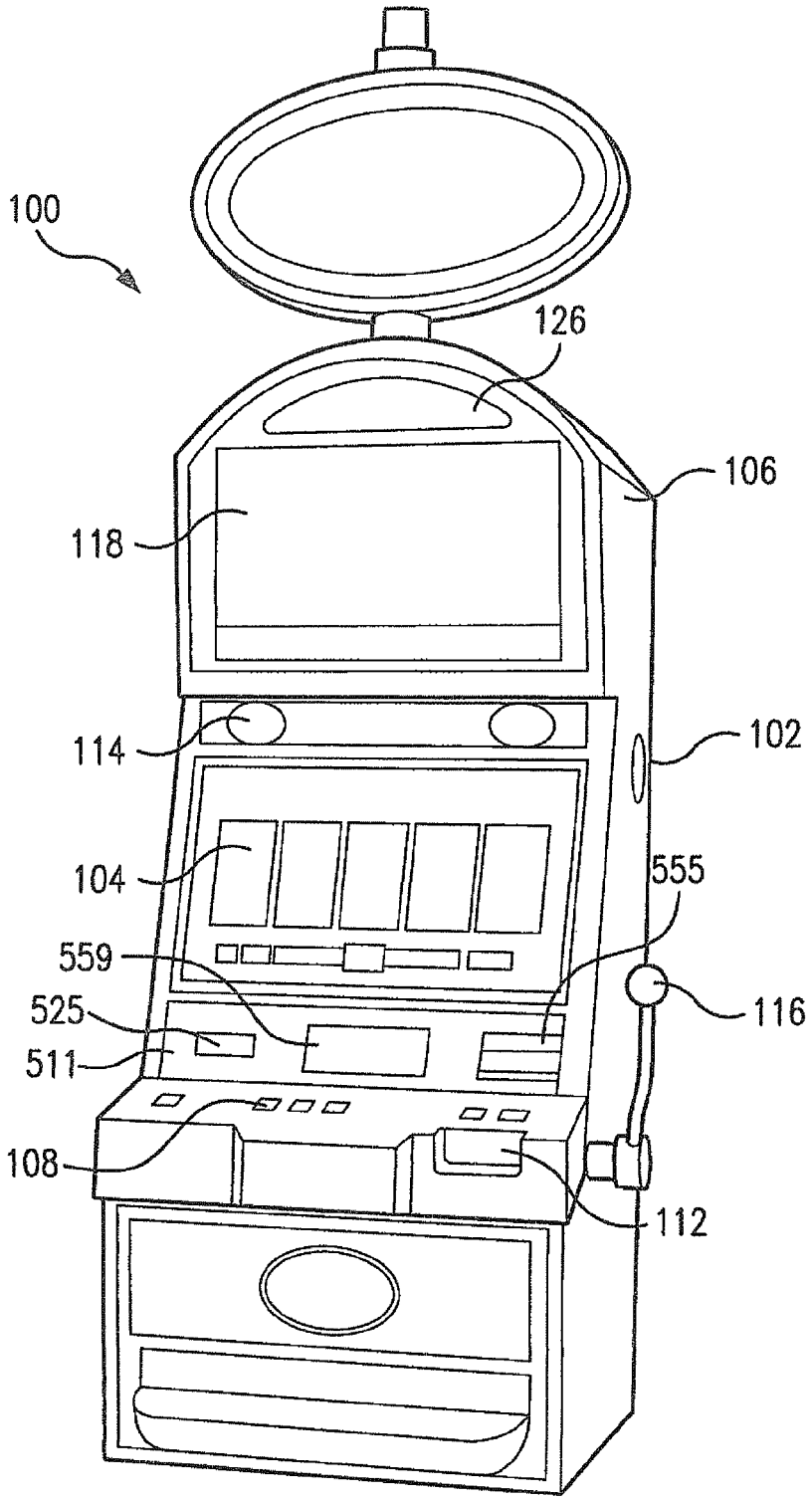
FIG. 1 illustrates an example of a gaming terminal of the type compatible with the systems and methods of the present invention.

Referring now to the drawings, wherein like reference numbers denote like or corresponding elements throughout the drawings, and more particularly referring to FIG. 1, a gaming terminal 100 according to the prior art is shown. The gaming terminal 100 includes cabinet housing 102, primary game display 104 upon which a primary game and feature game may be displayed, top box 106 which may display multiple progressive prizes that may be won during play of the feature game, a game input device 108 shown as player-activated button panel, player tracking module 511 (such as a player tracking interface device sold by Bally Technologies, Inc as an iView® device), bill/voucher acceptor 112 and one or more speakers 114. The housing 102 may be a self-standing unit that is generally rectangular in shape and may be manufactured with reinforced steel or other rigid materials which are resistant to tampering and vandalism. The housing 102 may alternatively be a handheld device including the gaming functionality as discussed herein and including the several of the described components herein. For example, a handheld device may be a cell phone, personal digital assistant, or laptop or tablet computer, each of which may include or interface with a display, a processor, and memory sufficient to support either stand-alone capability such as gaming terminal 100 or thin client capability such as that incorporating some of the capability of a remote server.

In one or more embodiments, the housing 102 houses a processor, circuitry, and software (not shown) for receiving signals from the game input device 108, operating the games, and transmitting signals to the respective displays and speakers. Any shaped cabinet may be implemented with any embodiment of gaming terminal 100 so long as it provides access to a player for playing a game. For example, the housing 102 may comprise a slant-top, bar-top, or table-top style cabinet, including a Bally Cinevision™ or CineReels™ cabinet. The operation of gaming terminal 100 is described more fully below.

The plurality of player-activated buttons of the game input device 108 may be used for various functions such as, but not limited to, selecting a wager denomination, selecting a game to be played, selecting a wager amount per game, initiating a game, or cashing out money from gaming terminal 100. Buttons may be operable as input mechanisms and may include mechanical buttons, electromechanical buttons or touch screen buttons. Optionally, a handle 116 may be rotated by a player to initiate a game.

In one or more embodiments, the buttons if the game input device 108 may be replaced with various other input mechanisms known in the art such as, but not limited to, a touch screen system, touch pad, track ball, mouse, switches, toggle switches, or other input means used to accept player input. For example, one input means is a universal button module as disclosed in U.S. Pub. 2006/0247047, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Housing 102 may optionally include the top box 106 which contains "top glass" 118 comprising advertising or payout information related to the game or games available on gaming terminal 100. The player tracking module 511 includes system interface configured to include a card reader 555 of the type for reading the magnetic stripe on a player loyalty card and communicating with the gaming system. As hereinafter described in accordance with the several embodiments of the present invention the system interface may include a near field communication (NFC) device for contactless communication with portable device such as a smart cart. A player tracking module display 559 is provided on the player tracking module 511 to display messages such as system generated messages to the players and to casino personnel. A voucher printer 525 may be integrated into the player tracking module 511 or installed elsewhere on the housing 102 or top box 106. Artwork 126 may complete the top box 106.

The glass 118 in the top box 106 may instead be secondary electronic display to display game information, bonus games or the like.

The primary game display 104 typically presents a game of chance wherein a player receives one or more outcomes from a set of potential outcomes. For example, one such game of chance is a video slot machine game. In other aspects of the invention, gaming terminal 100 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include terminal displays such as mechanical reels, wheels, or dice as required to present the game to the player. In video/mechanical or pure video embodiments, the primary game display 104 is, typically, a CRT or a flat-panel display in the form of, but not limited to, liquid crystal, plasma, electroluminescent, OLED, vacuum fluorescent, field emission, or any other type of panel display known or developed in the art. The primary game display 104 may be mounted in either a "portrait" or "landscape" orientation and be of standard or "widescreen" dimensions (i.e., a ratio of one dimension to another of at least 16:9). For example, a widescreen display may be 32 inches wide by 18 inches tall. A widescreen display in a "portrait" orientation may be 32 inches tall by 18 inches wide. Additionally, primary game display 104 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571 entitled "Gaming Device with Direction and Speed Control of Mechanical Reels Using Touch Screen," which is hereby incorporated by reference. Where the primary game display 104 is oriented in a portrait mode it may define both the primary game display 104 as well as the glass 118 where it creates a secondary game display.

The primary game display 108 may also present information such as, but not limited to, player information, advertisements and casino promotions, graphic displays, news and sports updates, or even offer an alternate game. This information may be generated through a host computer networked with gaming terminal 100 on its own initiative or it may be obtained by request of the player using an input device for example embodied as either one or more of the plurality of player-activated touch screen buttons at the primary game display 104 or buttons/icons located on the player tracking module 511 (shown in FIG. 1).

While the primary embodiments of the present invention are described with reference to gaming terminals and a player tracking loyalty and banking system, it should be understood that many aspects could be used in other environments such as customer loyalty programs for retailers, airline frequent flyer programs, banking, Internet commerce or the like. In instances other than gaming the terminals would be kiosks, check-out terminals or portable devices.

The gaming terminal 100 (shown as one or more gaming terminals 832) is typically included in a gaming system 830 as will hereinafter be described with reference to FIG. 4. The environment may be a single casino at a single geographic location or it may be several casino venues at different locations.

Figure 2A:
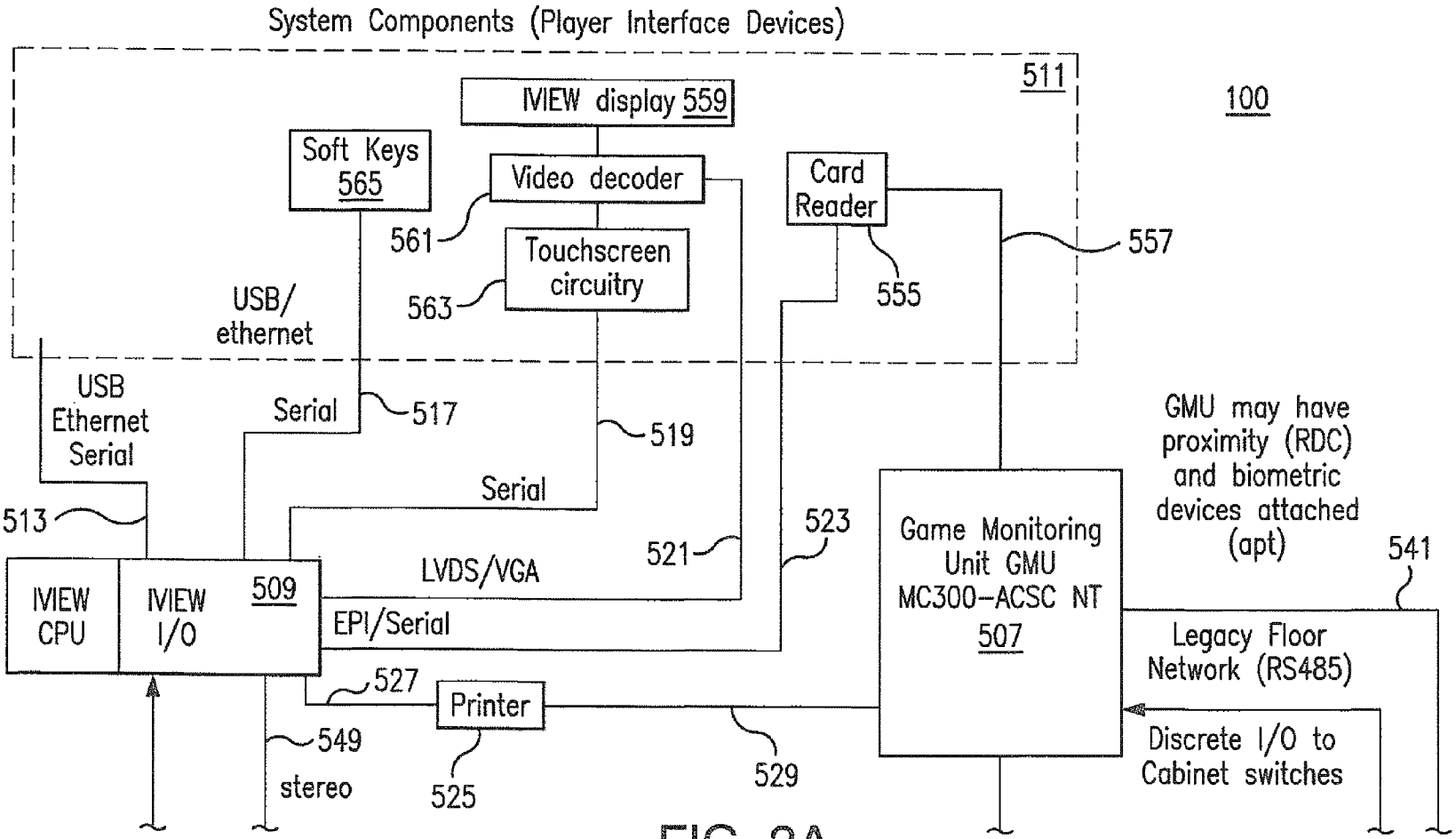
FIGS. 2A and 2B illustrates a functional diagram of the components of a gaming terminal of FIG. 1.
Figure 2B:
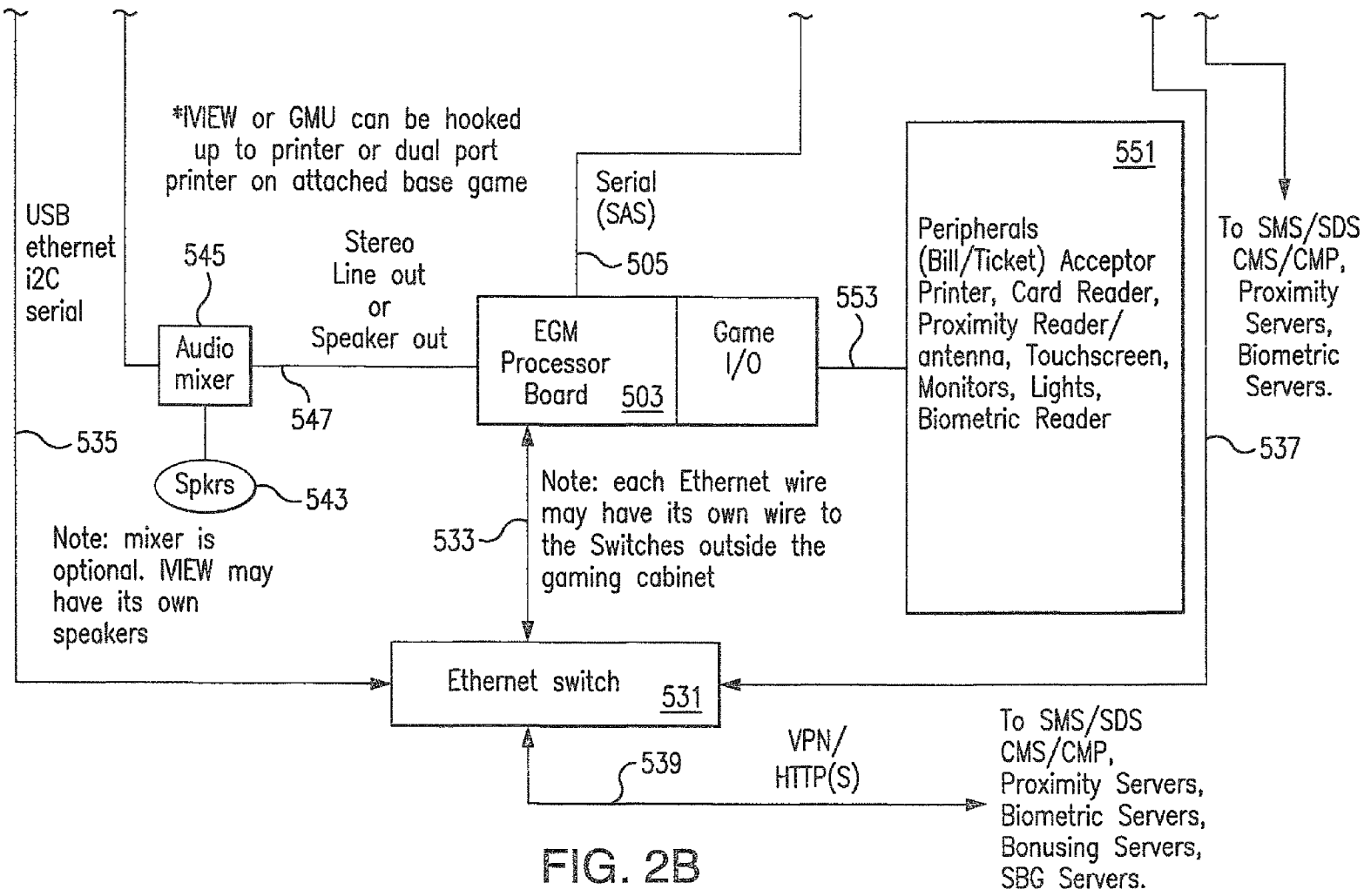

Referring to FIGS. 2A, B, the gaming terminal 100 hardware 501 for their controller(s) is shown in accordance with one or more embodiments. The hardware 501 includes base game integrated circuit board 503 (EGM Processor Board) connected through serial bus line 505 to game monitoring unit (GMU) 507 (such as a Bally MC300 or ACSC NT), and player interface integrated circuit board (PIB) 509 connected to a player tracking module (PTM) 511 over bus lines 513, 517, 519, 521, 523. The PTM 511 provides for communication between the gaming terminals and the system 830. Inasmuch as gaming terminals 100 may be manufactured by different entities, mounting like PTMs 511 at each gaming terminal 100 provides for communication to the system in one or more common message protocols. Gaming voucher ticket printer 525 (for printing player cash out tickets) is connected to PIB 509 and GMU 507 over bus lines 527, 529. EGM Processor Board 503, PIB 509, and GMU 507 connect to Ethernet switch 531 over bus lines 533, 535, 537. Ethernet switch 531 connects to a slot management system and a casino management system (SMS, SDS, CMS and CMP) 830 (FIG. 4) network over bus line 539. Ethernet switch 531 may also connect to a server based gaming server or a downloadable gaming server. GMU 507 also may connect to the network over bus line 541. Speakers 543 to produce sounds related to the game or according to the present invention connect through audio mixer 545 and bus lines 547, 549 to EGM Processor Board 503 and PIB 509.

Peripherals 551 connect through bus 553 to EGM Processor Board 503. The peripherals 551 include, but are not limited to the following and may include individual processing capability: bill/voucher acceptor 112 to validate and accept currency and ticket vouchers, communication component 120, the player interfaces such a buttons 108, displays 104 and any secondary or tertiary displays (with/without) touch screen functionality, monitors and lights. For example, the bill/voucher acceptor 112 is typically connected to the game input-output board of the EGM processing board 503 (which is, in turn, connected to a conventional central processing unit ("CPU") board), such as an Intel Pentium® microprocessor mounted on a gaming motherboard. The I/O board may be connected to CPU processor board by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. EGM processor board 503 executes a game program that causes the gaming terminal 100 to display and play a game. The various components and included devices may be installed with conventionally and/or commercially available components, devices, and circuitry into a conventional and/or commercially available gaming terminal housing 102.

When a player has inserted a form of currency such as, for example and without limitation, paper currency, coins or tokens, cashless tickets or vouchers, electronic funds transfers or the like into the currency acceptor, a signal is sent by way of bus 553 to the I/O board and to EGM processor board 503 which, in turn, assigns an appropriate number of credits for play in accordance with the game program. The player may further control the operation of the gaming machine by way of other peripherals 551, for example, to select the amount to wager via the player input device 108. The game starts in response to the player operating a start mechanism such as the handle 116, button such as a SPIN/RESET button or a touch screen icon. The game program includes a random number generator to provide a display of randomly selected indicia on one or more displays such as the primary game display 104 as shown in FIG. 1. In some embodiments, the random generator may be physically separate from gaming terminal 100; for example, it may be part of a central determination host system which provides random game outcomes to the game program. Finally, EGM processor board 503 under control of the game program and OS compares the final display of indicia to a pay table. The set of possible game outcomes may include a subset of outcomes related to the triggering of a feature or bonus game. In the event the displayed outcome is a member of this subset, EGM processor board 503, under control of the game program and by way of I/O Board 503, may cause feature game play to be presented on the primary game display 104 and/or any secondary display(s).

Predetermined payout amounts for certain outcomes, including feature game outcomes, are stored as part of the game program. Such payout amounts are, in response to instructions from processor board 503, provided to the player in the form of coins, credits or currency via I/O board and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In an embodiment, the remote storage device is housed in a remote server such as a downloadable gaming server. The gaming machine may access the remote storage device via a network connection, including but not limited to, a local area network connection, a TCP/IP connection, a wireless connection, or any other means for operatively networking components together. Optionally, other data including graphics, sound files and other media data for use with the gaming terminal are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the gaming terminal using USB, serial or Ethernet connections. Each of the respective devices may have upgrades to their firmware utilizing these connections.

GMU 507 includes an integrated circuit board and GMU processor and memory including coding for network communications, such as the G2S (game-to-system) protocol from the Gaming Standards Association, Las Vegas, Nev., used for system communications over the network. As shown, GMU 507 may connect to a card reader 555 (shown as 120 in FIG. 1) through bus 557 and may thereby obtain player information and transmit the information over the network through bus 541. Gaming activity information may be transferred by the EGM Processor Board 503 to GMU 507 where the information may be translated into a network protocol, such as S2S, for transmission to a server, such as a player tracking server, where information about a player's playing activity may be stored in a designated server database.

PID 509 includes an integrated circuit board, PID processor, and memory which includes an operating system, such as Windows CE, a player interface program which may be executable by the PID processor together with various input/output (I/O) drivers for respective devices which connect to PID 509, such as player tracking module 511, and which may further include various games or game components playable on PID 509 or playable on a connected network server and PID 509 is operable as the player interface. PID 509 connects to card reader 555 through bus 523, player tracking display 559 through video decoder 561 and bus 521, such as an LVDS or VGA bus.

As part of its programming, the PID processor executes coding to drive player tracking display 559 and provide messages and information to a player. Touch screen circuitry 563 interactively connects display 559 and video decoder 561 to PID 509 such that a player may input information and cause the information to be transmitted to PID 509 either on the player's initiative or responsive to a query by PID 509. Additionally soft keys 565 connect through bus 517 to PID 509 and operate together with the player tracking display 559 to provide information or queries to a player and receive responses or queries from the player. PID 509, in turn, communicates over the CMS/SMS network through Ethernet switch 531 and busses 535, 539 and with respective servers, such as a player tracking server.

Player tracking devices 511 are linked into the virtual private network of the system components in gaming terminal 100. The system components include the player tacking module 511 (e.g. Bally iVIEW® device) ('iView" is a registered trademark of Bally Gaming, Inc.) processing board 503 and game monitoring unit (GMU) processing board 507. These system components may connect over a network to the slot management system (such as a commercially available Bally SDS/SMS) and/or casino management system (such as a commercially available Bally CMP/CMS).

The GMU 507 system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the PTM 511 processing board and game monitoring unit (GMU) processing board 507. The GMU 507 and PTM 511 can be combined into one like the commercially available Bally GTM iVIEW device. This device may have a video mixing technology to mix the EGM processor's video signals with the iVIEW display onto the top box monitor or any monitor on the gaming device.

Figure 3:
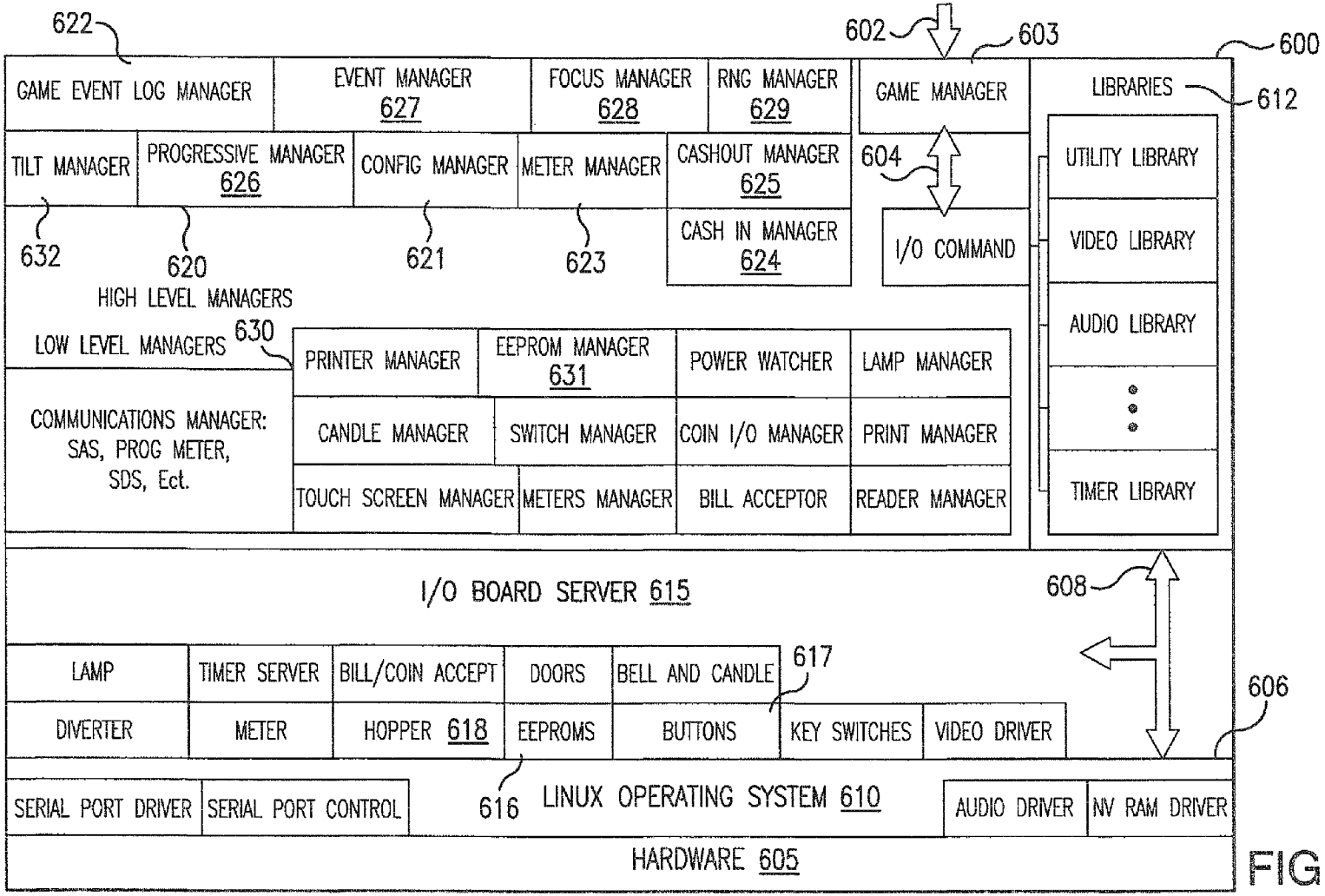
FIG. 3 is a block diagram of the logical components of a gaming kernel for the gaming terminal.
Figure 6:
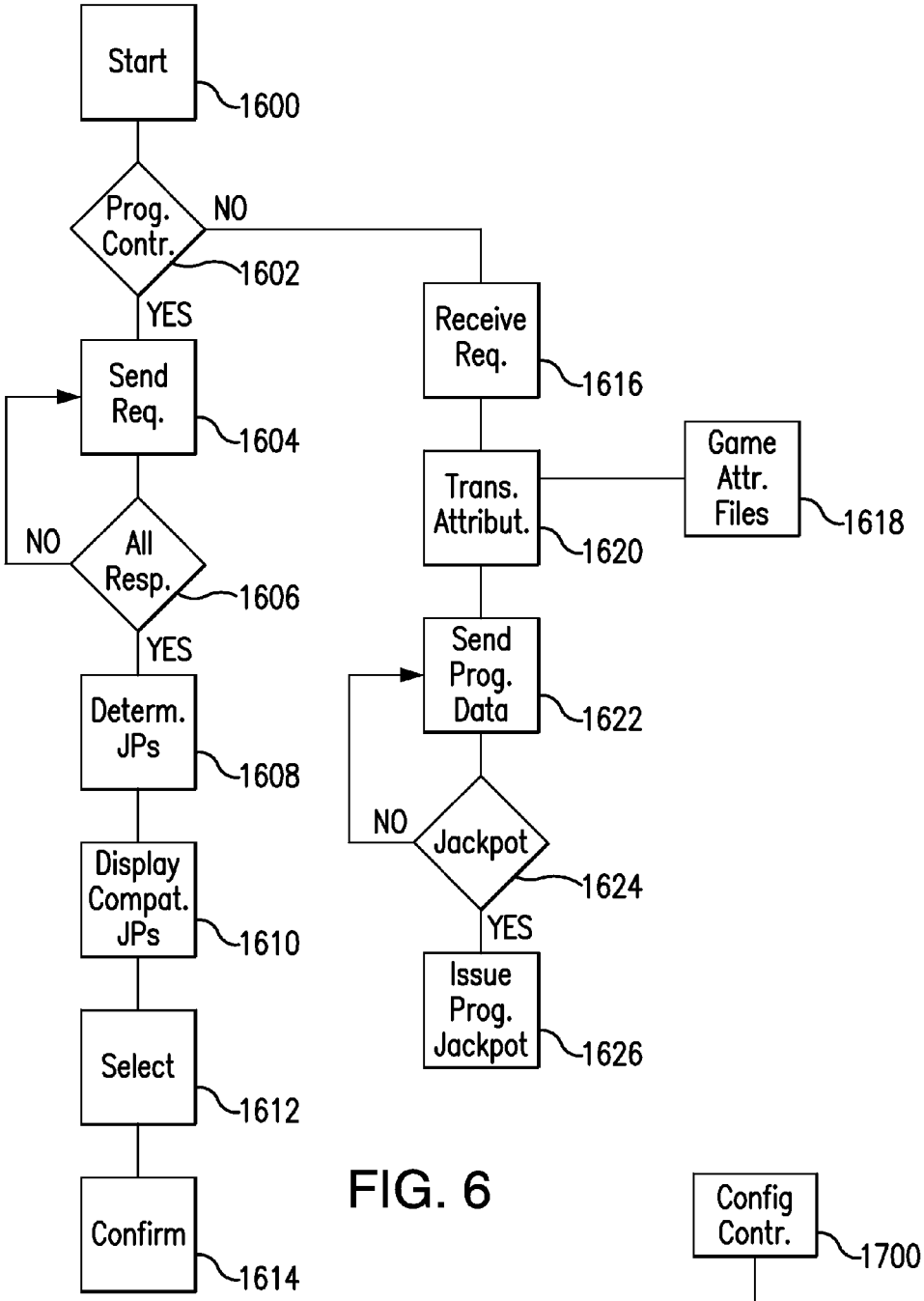
FIG. 6 is a process diagram for setting up the controller for a bank of gaming terminals.

In accordance with one or more embodiments, FIG. 3 is a functional block diagram of a gaming kernel 600 of a game program under control of gaming terminal processor board 503. The game program uses gaming kernel 600 by calling into application programming interface (API) 602, which is part of game manager 603. The components of game kernel 600 as shown in FIG. 6 are only illustrative, and should not be considered limiting. For example, the number of managers may be changed, additional managers may be added or some managers may be removed without deviating from the scope and spirit of the invention.

As shown in the example, there are three layers: a hardware layer 605; an operating system layer 610, such as, but not limited to, Linux; and a game kernel layer 600 having game manager 603 therein. In one or more embodiments, the use of an operating system layer 610, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 600 executes at the user level of the operating system layer 610, and itself contains a major component called the I/O board server 615. To properly set the bounds of game application software (making integrity checking easier), all game applications interact with gaming kernel 600 using a single API 602 in game manager 603. This enables game applications to make use of a well-defined, consistent interface, as well as making access points to gaming kernel 600 controlled, where overall access is controlled using separate processes.

For example, game manager 603 parses an incoming command stream and, when a command dealing with I/O comes in (arrow 604), the command is sent to an applicable library routine 612. Library routine 612 decides what it needs from a device, and sends commands to I/O board server 615 (see arrow 608). A few specific drivers remain in operating system layer 610's kernel, shown as those below line 606. These are built-in, primitive, or privileged drivers that are (i) general (ii) kept to a minimum and (iii) are easier to leave than extract. In such cases, the low-level communications is handled within operating system layer 610 and the contents passed to library routines 612.

Thus, in a few cases library routines may interact with drivers inside operating system layer 610, which is why arrow 608 is shown as having three directions (between library routines 612 and I/O board server 615, or between library routines 612 and certain drivers in operating system layer 610). No matter which path is taken, the logic needed to work with each device is coded into modules in the user layer of the diagram. Operating system layer 610 is kept as simple, stripped down, and common across as many hardware platforms as possible. The library utilities and user-level drivers change as dictated by the game cabinet or game machine in which it will run. Thus, each game cabinet or game machine may have an industry standard EGM processing board 503 connected to a unique, relatively dumb, and as inexpensive as possible I/O adapter board 540, plus a gaming kernel 600 which will have the game-machine-unique library routines and I/O board server 615 components needed to enable game applications to interact with the gaming machine cabinet. Note that these differences are invisible to the game application software with the exception of certain functional differences (i.e., if a gaming cabinet has stereo sound, the game application will be able make use of API 602 to use the capability over that of a cabinet having traditional monaural sound).

Game manager 603 provides an interface into game kernel 600, providing consistent, predictable, and backwards compatible calling methods, syntax, and capabilities by way of game application API 602. This enables the game developer to be free of dealing directly with the hardware, including the freedom to not have to deal with low-level drivers as well as the freedom to not have to program lower level managers 630, although lower level managers 630 may be accessible through game manager 603's interface 602 if a programmer has the need. In addition to the freedom derived from not having to deal with the hardware level drivers and the freedom of having consistent, callable, object-oriented interfaces to software managers of those components (drivers), game manager 603 provides access to a set of upper level managers 620 also having the advantages of consistent callable, object-oriented interfaces, and further providing the types and kinds of base functionality required in casino-type games. Game manager 603, providing all the advantages of its consistent and richly functional game application API 602 as supported by the rest of game kernel 600, thus provides a game developer with a multitude of advantages.

Game manager 603 may have several objects within itself, including an initialization object (not shown). The initialization object performs the initialization of the entire game machine, including other objects, after game manager 603 has started its internal objects and servers in appropriate order. In order to carry out this function, the kernel's configuration manager 621 is among the first objects to be started; configuration manager 621 has data needed to initialize and correctly configure other objects or servers.

The high level managers 620 of game kernel 600 may include game event log manager 622 which provides, at the least, a logging or logger base class, enabling other logging objects to be derived from this base object. The logger object is a generic logger; that is, it is not aware of the contents of logged messages and events. The game event log manager's 622 job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 623 manages the various meters embodied in the game kernel 600. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 623 receives its initialization data for the meters, during start-up, from configuration manager 621. While running, the cash in manager 624 and cash out manager 625 call the meter manager's 623 update functions to update the meters. Meter manager 623 will, on occasion, create backup copies of the soft meters by storing the soft meters' readings in EEPROM. This is accomplished by calling and using EEPROM manager 631.

In accordance with still other embodiments, progressive manager 626 manages progressive games playable from the game machine. Event manager 627 is generic, like game event log manager 622, and is used to manage various gaming machine events. Focus manager 628 correlates which process has control of various focus items. Tilt manager 632 is an object that receives a list of errors (if any) from configuration manager 621 at initialization, and during game play from processes, managers, drivers, etc. that may generate errors. Random number generator manager 629 is provided to allow easy programming access to a random number generator (RNG), as a RNG is required in virtually all casino-style (gambling) games. Random number generator manager 629 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 625 has the responsibility of configuring and managing monetary output devices. During initialization, cash out manager 625, using data from configuration manager 621, sets the cash out devices correctly and selects any selectable cash out denominations. During play, a game application may post a cash out event through the event manager 627 (the same way all events are handled), and using a call back posted by cash out manager 625, cash out manager 625 is informed of the event. Cash out manager 625 updates the credit object, updates its state in non-volatile memory, and sends an appropriate control message to the device manager that corresponds to the dispensing device. As the device dispenses dispensable media, there will typically be event messages being sent back and forth between the device and cash out manager 625 until the dispensing finishes, after which cash out manager 625, having updated the credit manager and any other game state (such as some associated with meter manager 623) that needs to be updated for this set of actions, sends a cash out completion event to event manager 627 and to the game application thereby. Cash in manager 624 functions similarly to cash out manager 625, only controlling, interfacing with, and taking care of actions associated with cashing in events, cash in devices, and associated meters and crediting.

In a further example, in accordance with one or more embodiments, I/O board server 615 may write data to the gaming machine EEPROM memory, which is located in the gaming machine cabinet and holds meter storage that must be kept even in the event of power failure. Game manager 603 calls the I/O library functions to write data to the EEPROM. The I/O board server 615 receives the request and starts a low priority EEPROM thread 616 within I/O board server 615 to write the data. This thread uses a sequence of 8 bit command and data writes to the EEPROM device to write the appropriate data in the proper location within the device. Any errors detected will be sent as IPC messages to game manager 603. All of this processing is asynchronous.

In accordance with one embodiment, button module 617 within I/O board server 615, polls (or is sent) the state of buttons every 2 ms. These inputs are debounced by keeping a history of input samples. Certain sequences of samples are required to detect a button was pressed, in which case the I/O board server 615 sends an inter-process communication event to game manager 603 that a button was pressed or released. In some embodiments, the gaming machine may have intelligent distributed I/O which debounces the buttons, in which case button module 617 may be able to communicate with the remote intelligent button processor to get the button events and simply relay them to game manager 603 via IPC messages. In still another embodiment, the I/O library may be used for pay out requests from the game application. For example, hopper module 618 must start the hopper motor, constantly monitor the coin sensing lines of the hopper, debounce them, and send an IPC message to the game manager 603 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

B. System

Figure 4A:
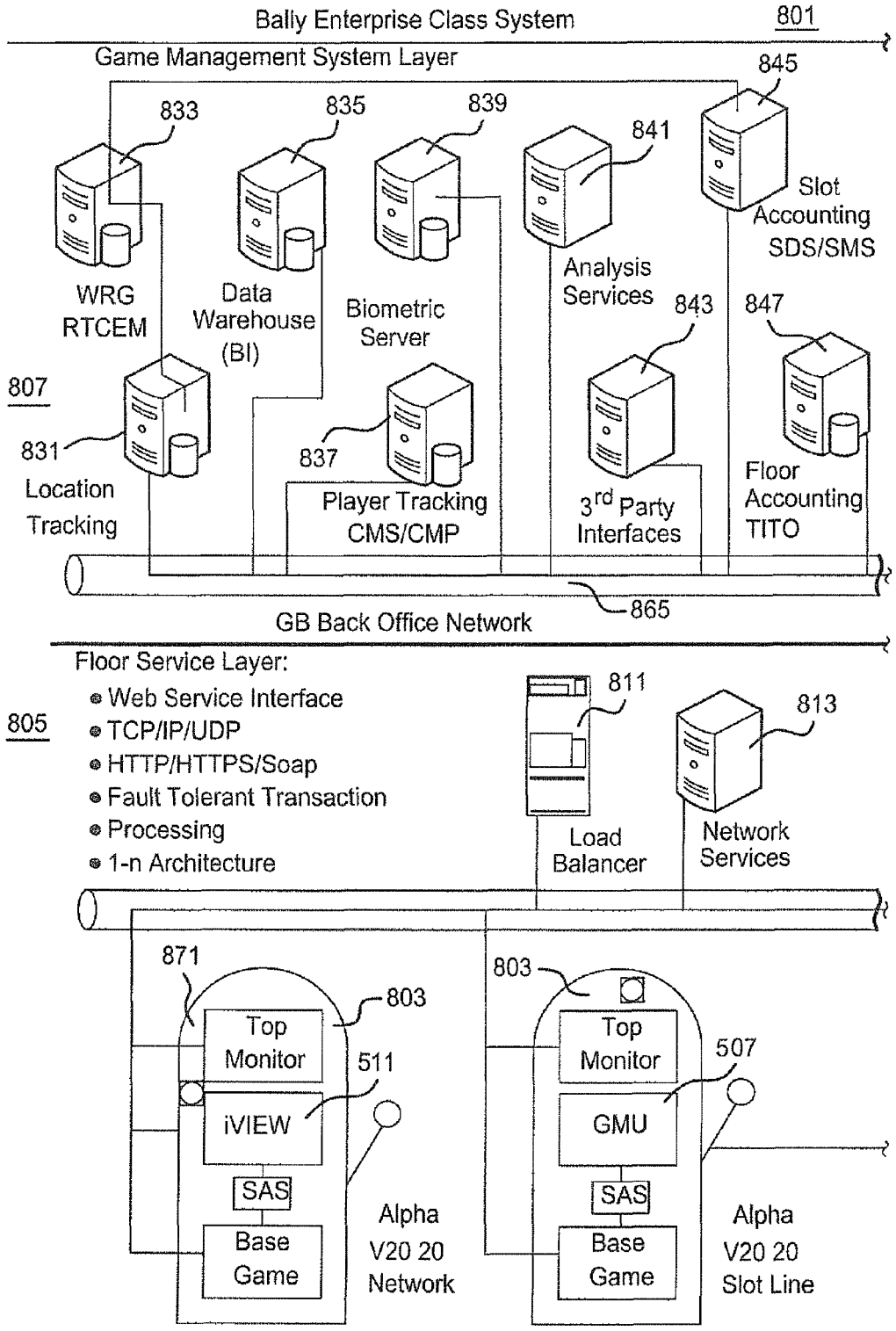
FIGS. 4A and 4B illustrates a diagram of a system configurable according to the systems and methods of the present invention.

Referring to FIGS. 4A and B, a gaming system 801 is shown in accordance with one or more embodiments. Gaming system 801 may include one casino or multiple locations and generally includes a network of gaming terminals 803 (such as a gaming terminals 100 as described in FIG. 1), floor management system (SMS) 805, and casino management system (CMS) 807. SMS 805 may include load balancer 811, network services server 813, player tracking module 511, iView (PTM 511) content servers 815, certificate services server 817, floor radio dispatch receiver/transmitters (RDC) 819, floor transaction servers 821 and game engines 823 (where the gaming terminals 803 operate server based or downloadable games), each of which may connect over network bus 825 to gaming terminals 803. CMS 807 may include location tracking server 831, WRG RTCEM server 833, data warehouse server 835, player tracking server 837, biometric server 839, analysis services server 841, third party interface server 843, slot accounting server 845, floor accounting server 847, progressives server 849, promo control server 851, bonus game (such as Bally Live Rewards) server 853, download control server 855, player history database 857, configuration management server 859, browser manager 861, tournament engine server 863 connecting through bus 865 to server host 867 and gaming machines 803. The various servers and gaming terminals 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming machines 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

The gaming terminals 803 include various peripheral components that may be connected with USB, serial, parallel, RS-485 or Ethernet devices/architectures to the system components within the respective gaming machine. The GMU 507 has a connection to the base game through a serial SAS connection. The system components in the gaming cabinet may be connected to the servers using HTTPs or G2S over Ethernet. Using CMS 807 and/or SMS 805 servers and devices, firmware, media, operating systems, and configurations may be downloaded to the system components of respective gaming devices for upgrading or managing floor content and offerings in accordance with operator selections or automatically depending upon CMS 807 and SMS 805 master programming. The data and programming updates to gaming devices 803 are authenticated using conventional techniques prior to install on the system components.

In various embodiments, any of the gaming terminals 803 may be a mechanical reel spinning slot machine, video slot machine, video poker machine, video bingo machine, keno machine, or a gaming device offering one or more of the above described games including an interactive wheel feature. Alternately, gaming terminals 803 may provide a game with an accumulation-style feature game as one of a set of multiple primary games selected for play by a random number generator, as described above. A gaming system 801 of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Gaming," filed on Nov. 9, 2007, which is hereby incorporated by reference in its entirety for all purposes.

The gaming system 801, among other functionalities such as slot accounting (i.e. monitoring the amount wagered ("drop"), awards paid) and other casino services, includes the player tracking CMS/CMP server 837 and/or data warehouse 835 storing player account data. This data includes personal data for players enrolled in the casino players club sometimes referred to as a loyalty club. An example of the personal data is the player's name, address, SSN, birth date, spouse's name and perhaps personal preferences such as types of games, preferences regarding promotions and the like. As is known in the industry and according to the prior art, at enrollment the player is assigned a created account in the player tracking CMS/CMP server 837 and is issued a player tracking card having a machine readable magnetic stripe. At enrollment the player may also be assigned to a "tier" level. For example, the casino or casino network may have a 3-tier player reward system labeling the tiers as, for example, a Silver Tier (Tier 1), a Gold Tier (Tier 2) and a Platinum Tier (Tier 3). These tier discriminators reflect a relative value of the player to the casino and are used to determine the type, nature and quantity of marketing and rewards offered to players. For example, at initial enrollment a player may be assigned into the Silver Tier and be entitled, based upon their commercial activity (wagering, purchases of goods/services) to certain rewards such as 2-for-1 show tickets, 2-for-1 buffet and the like. Through their commercial activity and over time the player may be viewed as a more valuable player and be "upgraded" to the Gold Tier where they receive more valuable rewards. The Platinum Tier is for the casino's most highly valued players. Rewards for the Platinum Tier would be more valuable. These promotions, according to the present invention, as well as player funds and other data are stored at, for example, the system server 853. The venue can update the promotions manually or via promotions configured and launched according to predetermined criteria. As but an example, the casino may configure a promotion to provide $25 in bonus play to Silver tier players, $30 to Gold tier players and $50 to Platinum tier players to become effective each Wednesday of the month between 1 pm and 8 pm to attract play during normally slow periods.

When a player plays a gaming terminal 100, he/she inserts their player tracking card into the card reader 555 (FIG. 2A) which communicates data to the CMS/CMP server 837 to accumulate loyalty points based upon the wagers/wins of the player. For example, a player may accumulate one loyalty point for each $5 wagered.

The system 801 may also include electronic transfer of funds functionality. For example, a player having accumulated $100 at a gaming terminal 100 may decide to "cash out" to play another gaming terminal. The player, for example using the player tracking module 511 to initiate communication with the system 801 for example server 837 to upload the value from the gaming terminal 100 into an electronic account associated with the player's account. The player may choose to upload all or a portion of the funds. The system would prompt the player to enter their PIN (or obtain biometrical confirmation as to the player's identity) and upload the chosen amount to their account. When the player moves to another gaming terminal 100 he/she inserts their player loyalty card into the card reader 555 to access their account. A prompt provides for the player to request funds from their account. Entering their PIN (or biometric identifier) the player can input the desired amount which is downloaded to their gaming terminal 100 for play.

While the above description has focused upon a system for the casino industry, it should be understood that systems for other industries such as airline frequent flyer programs and retail loyal programs operate functionally more or less as described.

C. Progressive Jackpot Configuration

Figure 5:
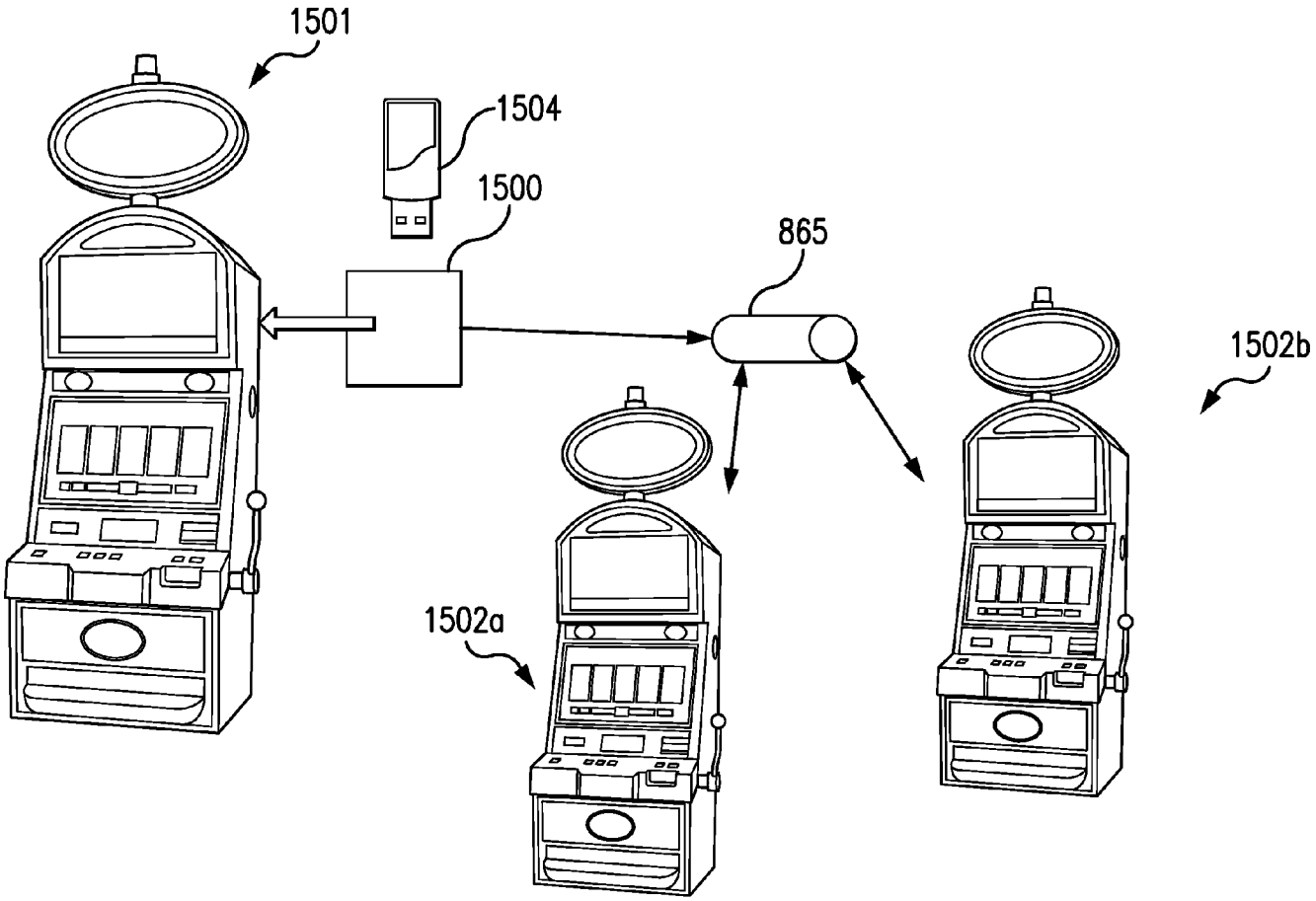
FIG. 5 illustrates the devices, systems and methods of the present invention.

Turning now to FIG. 5 there is illustrated the establishment of one or more linked progressive jackpots according to the present invention. There is shown a plurality of gaming terminals 100. For a group of gaming terminals 100 selected for arrangement into one or more progressives, one will be selected to define the progressive jackpot controller 1500 resulting in designating the other gaming terminals as clients 1502*a, b*. As an example the jackpot controller 1500 may be a separate device provided in each gaming terminal 100 or, preferably embodied as a software module resident, but normally dormant, in the gaming kernel 600. As an alternative the jackpot controller 1500 may be provided as part of the PTM 511.

The jackpot controller 1500 is configurable to establish the various progressive jackpot parameters. As but an example and as described below, an operator may prompt the jackpot controller 1500 to display at the primary game display 104 (or other display) a jackpot configuration menu including, game links, symbol-based progressive levels, e.g. top progressive through multiple, lesser level progressives for example up to eight progressive levels, mystery progressive levels up to, for example, eight mystery progressive levels, selections including, but not limited to, progressive jackpot name, wager denomination(s) supported by the progressive, reset value (the reset value the progressive will start at after the jackpot is won), increment rate (the rate of contribution usually denoted by a percentage of a wager on a participating gaming terminal), maximum jackpot value (if any), ability to enter end of life mode (increment rate set at 0% upon the next progressive award), override of the current jackpot value (to restore the progressive to the correct value such as after a RAM clear) and the like. Where a mystery progressive jackpot is provided the menu may also enable the operator to select the trigger such as a coin-in trigger or random trigger and the range within which the trigger is selected. Each established progressive jackpot will have an associated group name for reference purposes. Once the parameters have been established a "start progressive" button or message may be entered rendering most parameters as read-only. All configuration information is stored in NVRAM.

The jackpot controller 1500 is configured to determine, from the attributes of a gaming terminal game, which progressive jackpots the game (or mystery) is compatible with. By compatibility what is meant for symbol based jackpots is that the denomination, the expected money wagered to win the jackpot or odds to win the jackpot and other features of the game are compatible with the progressive jackpot and the other games linked thereto. As an example, Table 1 below shows a example of attributes for the games hosted on the gaming terminal 100 including the progressive controller, host terminal 1501 and two client gaming terminals 1502*a, b* for games where only a top level progressive is to be provided.

| Terminal | Games | Denomination | Max Bet | Odds to Jackpot |
|---|---|---|---|---|
| Host terminal 1501 | A | $0.25 | $0.75 | 1:30,000 |
| | B | $0.25 | $1.25 | 1:60,000 |
| | C | $1.00 | $3.00 | 1:150,000 |
| Client 1502a | D | $0.25 | $0.75 | 1:30,000 |
| | E | $1.00 | $3.00 | 1:150,000 |
| Client 1502b | F | $0.50 | $1.50 | 1:100,000 |
| | G | $0.25 | $0.75 | 1:30,000 |
| | H | $0.25 | $0.75 | 1:30,000 |

The games A-H of Table 1 may have the same or different themes. For example, game A may be a stepper game having a "Pirate" theme with the jackpot defined by the player receiving an outcome of three Pirate symbols and game G may be a video game having a "Baseball" theme with the jackpot defined by the player receiving three Baseball symbols. The games may be clones of one another, i.e. same pay table structure with only graphics changes or may be non-clone games. Common to the gaming terminals 100 is that each is configured to store data in a memory structure such as a non-volatile memory the attributes for each hosted game which are necessary for determining whether or not the games can be linked to one or more progressive jackpots. It should be noted that legacy games which do not include such a memory store must be manually linked to a progressive as will hereinafter become evident. As indicated above this attribute data may include game name, denomination, max bet, odds for winning the jackpot(s) (one or more games may have more than one progressive jackpot level such as, giving video Poker as an example, a primary and secondary progressive jackpot of a Royal Flush and four Aces with a 2, 3 or 4, amount expected to be wagered until the jackpot is won (odds to win the jackpot), data representing all or part of the pay table for the game or the like. In an embodiment the progressive controller 1500 may be configured or configurable to store data in a data structure relating to one or mystery jackpots including a mystery jackpot name, $ expected to be wagered until the jackpot is hit such as described in Torango, U.S. Pat. No. 6,592,460 issued Jul. 15, 2003 and titled "Progressive Wagering System" (the disclosure of which is incorporated by reference), denomination, criteria of issuing an award including award trigger selection criteria, accumulation rate to the jackpot and toward the reset value and the like. Alternatively the mystery jackpot configurations may be stored in a security dongle as hereinafter described.

Figure 4B:
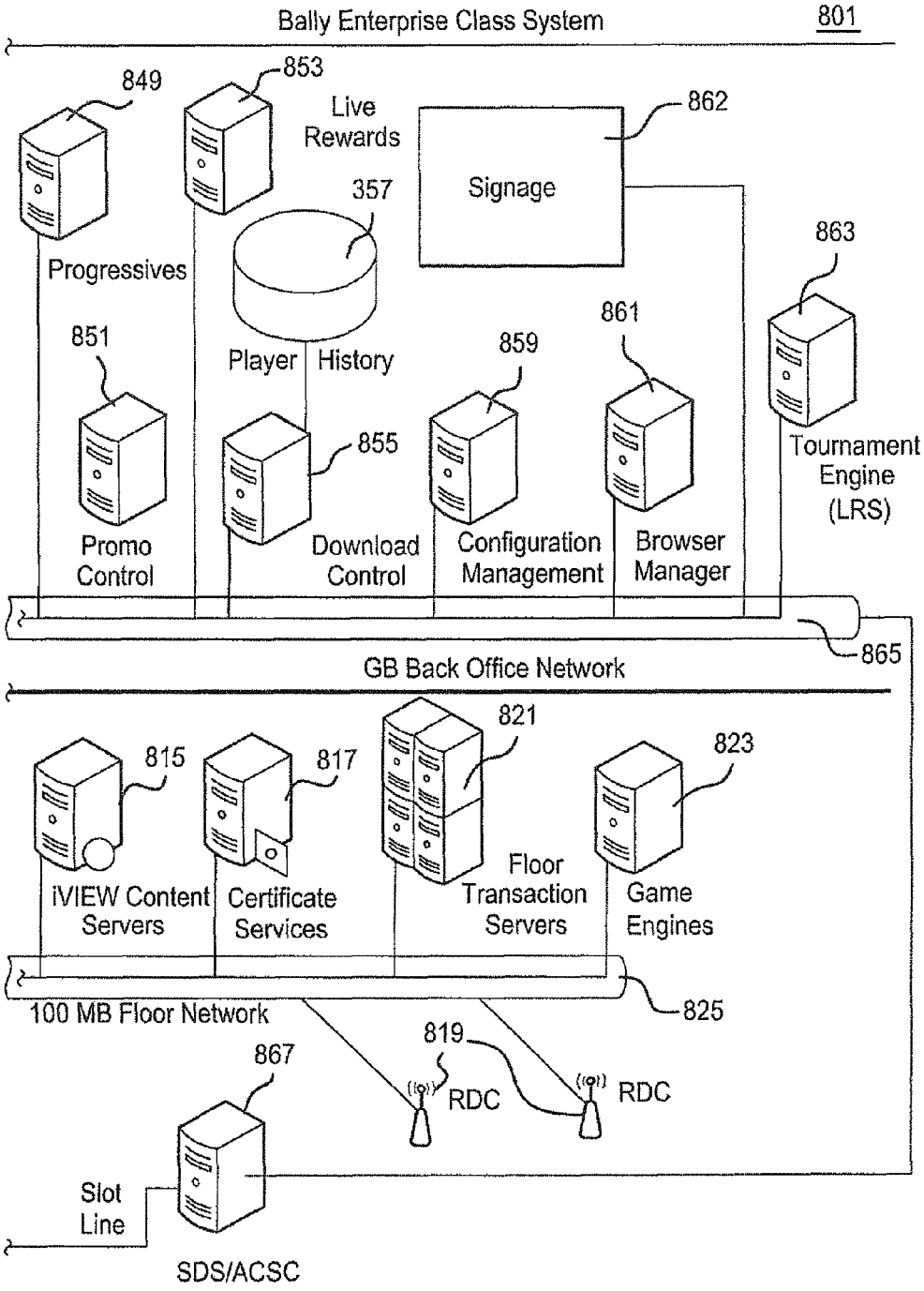

Continuing with FIG. 5, the jackpot controller 1500 is confined within the secure cabinet 102 of the host terminal 1501. It should be understood that where the gaming terminals 100 are connected to a network as described above, the progressive jackpot controller 1500 could be embodied as a software module installed within one or more network servers such as progressives server 849 (FIG. 4B). For purposes of this description it shall be assumed that the progressive jackpot controller 1500 is embodied as part of the gaming terminal kernel 600 or otherwise as a software module of the operating software platform of the gaming terminals 100. For purposes of illustration gaming terminal 1501 has been selected to be the progressive host terminal. The progressive jackpot controller 1500 is in communication with other gaming terminals including the client terminals 1502*a, b* though the network bus 865. The progressive jackpot terminal 1500 is also in communication with one or more displays at the gaming terminals 100 including, for example the host terminal 1501 or the host terminal 1501 and each client terminal 1502*a, b*. For this purpose the progressive jackpot controller 1500 may access the primary game display(s) 104, glass 118 embodied as a secondary video displays or PTM displays 559. Where the progressive jackpot controller 1500 communicates with the primary game display(s) 104 the communication path is through the processor board 503 and GMU 507. The progressive jackpot controller 1500 may also communicate with external video displays such as a video display over a bank of linked gaming terminals to display progressive information such as the current jackpot amount(s) to induce play of the linked gaming terminals.

The progressive jackpot controller 1500 and the system of the present inventions are subject to security measures. For example, where the gaming terminals 100 are from Bally Gaming, Inc. of Las Vegas, Nev. and are Alpha Pro™ terminals, the progressive jackpot controller 1500 is a software module of the operating system which is provided in each gaming terminal 100 but remain dormant until activated. The progressive jackpot controller 1500 communicates using a multi-link protocol (MML) which is encrypted and utilizes SSL security standards to ensure communication integrity. Other communication protocols and message security methods may be used. Additional protection is provided through the license USB dongle 1504 and that key configuration settings cannot be changed without a RAM clear. When the dongle 1504 is connected to the gaming terminal 100 processor board 503 the progressive jackpot controller 1500 software module of the gaming kernel 600 is activated thereby designating the gaming terminal 100 as the progressive host terminal 1501. The dongle 1504 and gaming kernel 600 may operate to authenticate one another such as by using public key-private key cryptology. Unless the dongle 1504 is connected to the gaming terminal platform the progressive jackpot controller 1500 will not operate. The dongle 1504 includes a data structure storing not only the compatible public key-private key data but also configuration data such as the allowed number of gaming terminals that may subscribe to the progressive jackpot controller 1500, mystery jackpot configuration(s), etc. Thus the dongle 1504 is a necessary component to establishing the progressive links according to the present invention enabling the provider to control, under commercial terms, the enablement of the progressive jackpots according to the present invention through suitable dongle licenses. Each progressive jackpot link supported by the progressive jackpot controller 1500 is assigned a link identification such as a Group ID. For each named link the progressive jackpot controller 1500 has an associated non-volatile memory storing information including:

Denomination
List of acceptable Pay table. Denomination pairs
Link ID
EGMs contributing to link
Number of progressive levels
Level data includes:
Cost-Of-Jackpot (Odds-To-Jackpot*Max Bet)
Maximum Jackpot value
Reset Amount
Contribution percentage
Current contributions
Jackpot ID The progressive jackpot controller 1500 can be configured either through a series of menus displayed at the host terminal 1501 primary display 104 or a secondary display or, if no video display is provided, on a portable device such as a laptop PC connected to the EGM processor board 503. When the progressive jackpot controller is enabled a "New Bank Set-up" prompt is issued to the operator at the host terminal 1502 and, if desired, the client terminals 1502*a, b*. The set-up routine will display present the operator with a list of the discovered progressive controller hosts on the network. The operator will select, by Group ID, one of the discovered hosts or enter the IP Address of a host in another sub-net. At a first client terminal 1502*a, b* (or the host terminal 1501) a game is selected for linkage to a progressive jackpot. For purposes of explanation it shall be assumed that the operator at the host terminal 1501 selects Game A for association with a progressive. The first selected game association with a Group ID will lock in the associative attributes necessary for the link. With the selection of Game A the operator has locked in a denomination ($0.25), max bet ($0.75) and odds (1:30,000) (which also translates to a cost to jackpot of $0.75×30,000=$22,500). The progressive jackpot controller 1500 broadcasts this association and available clients report back if they have any games compatible for association with the Group 1 progressive. FIG. 6 illustrates the process. At 1600 the process is started. If the dongle 1504 has been attached to the gaming terminal 100, at 1602 the gaming terminal 100 assumes the status of the progressive jackpot host 1501. At 1604, as described above the host terminal 1501 broadcasts a request for client terminals 1502, a, b to report any games compatible with the Group 1 progressive. Client terminals 1502*a, b* report back to the progressive jackpot controller that Games D, G and H are compatible. Compatibility may be determined by the jackpot controller 1500 whereupon the client terminals 1502*a, b* send all of their game attribute data for that determination to be made or each client terminal 1502*a, b* makes the determination based upon the Group 1 jackpot attributes. If all gaming terminals 100 have not responded the progressive jackpot controller 1500 may re-broadcast the request at 1606. At 1608 the progressive jackpot controller 1500 determines which games are compatible with the Group 1 progressive and at 1610 displays the terminals (in this example the host and client terminals 1501, 1502*a, b*) and the games (Games A, D, G and H) which have game attributes compatible with the Group 1 progressive. At 1612 the operator selects to link the Games A, D, G and H to the Group 1 progressive and at 1614 confirms and locks in the link. In a like manner Games C and E may be linked to a Group 2 progressive jackpot. Confirmation of the linkage may be done at the host terminal 1501 display or at the client terminals 1502*a, b*.

Continuing with FIG. 6, at 1616 the client terminals 1502*a, b* receive the broadcast request to report game attributes. Accessing a data structure 1618 storing such data, the client terminals 1502*a, b* at 1620 report their game attributes for the progressive jackpot controller 1500 to determine the available and compatible progressive jackpot links. Once linked, as a linked game is played at 1622 the client terminals 1502*a, b* transmit progressive related data to the progressive jackpot controller 1502 over the network bus 865 as well as test for a qualifying jackpot outcome at 1624. If no jackpot is won on a play, the loop persists. If a jackpot outcome is obtained at 1626 the event notification is sent to the progressive jackpot controller 1502 and the progressive is awarded to the player.

It should be understood that the automatic configuration of the client terminals 1502*a, b* to the progressive jackpot controller simplifies the set-up and avoids configuration errors.

Figure 7:
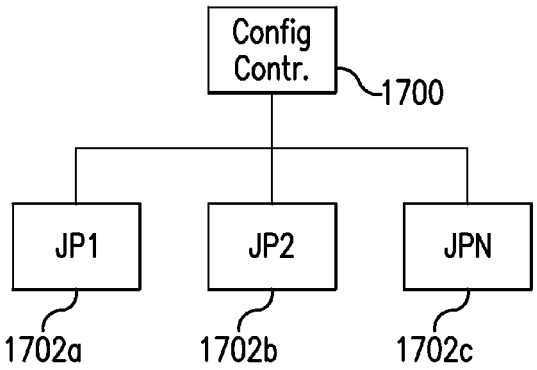
FIG. 7 shows the progressive jackpot configurations.

FIG. 7 shows the progressive jackpot configurations. At 1700 the configuration controller resident in the game kernel 600 or operating system software or dongle 1504 stores data corresponding to progressive jackpot configurations 1702*a-c* which differ, for example, in denomination, money to jackpot or the like. Alternatively, when a game is first selected to initiate the progressive jackpot set-up, the attributes of the game may be used to define the attributes for the progressive jackpot group.

Where a mystery jackpot is desired, the dongle 1504 may be programmed with the mystery jackpot configuration requirements such as denomination, max bet, trigger parameters, money to jackpot, contribution to the prize and next prize seed and the like. Upon selection of the mystery during configuration, the progressive jackpot controller 1504 determines which games are compatible with the selected mystery and provides the operator with a menu to link the compatible games and terminals to the mystery.

A small set of meters are maintained at the gaming terminal 1501 hosting the progressive jackpot controller 1502. These meters may store the following information and be accessible through a menu displayed at the host terminal 1501.

Total number of games played contributing to that link

Total wagers applied to the link

Total number of jackpots awarded

Total amount of jackpots awarded

A set of menus may be provided to display history logs for the progressive. A sub-menu of logs for each progressive link may include;

Current snapshot of progressive configuration including broadcast amounts.

The last N unique broadcasts including a timestamp and level amounts. Duplicate broadcasts will not be presented. [The value for the number N is TBD]

The last N contributions to the progressive link including timestamp, wager amount, and the MML client IP Address. [The value for the number N is TBD]

The last N jackpots awarded including a timestamp, the MML client IP Address, the level and the jackpot amount. [The value for the number N is TBD]

The last N errors encountered including a timestamp and error information. [The value for the number N is TBD]

An operator menu is provided for the writing of accounting and status information to a removable USB storage device such as a thumb drive or a micro-disk in a CSV format so that it can be imported into a spreadsheet application on a PC.

Appendices A-D provide additional description and are incorporated by reference.

The foregoing description, for purposes of explanation, uses specific nomenclature and formula to provide a thorough understanding of the invention. It should be apparent to those of skill in the art that the specific details are not required in order to practice the invention. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A progressive system including a plurality of gaming machines in communication over a network, each gaming machine configured to operate and display at a display at least one game, the system comprising:

each gaming machine is configured to play a selected one of two or more wagering games having different configuration attributes and each having a processor and a memory storing data representing configuration attributes including wager denomination and pay table data of each wagering game, a credit meter and a bill/voucher acceptor for accepting and validating physical instruments to establish credits at the credit meter for the play of the wagering game;

a progressive controller including software for operation of a plurality of progressive jackpots each compatible with a game having different attributes;

the controller configured to communicate over said network to one or more of the gaming machines to access data corresponding to said game attributes, to determine for each game any progressive jackpot which would be compatible with the game attributes, to control the display for each communicating gaming machine to display one or more compatible progressive jackpot associations for selection to associate the games with the compatible progressive jackpots and to receive from an input device a selection to associate a game to a compatible progressive jackpot; and a portable security device connectable to said controller to unlock controller to configure the progressive jackpot associations.

2. A gaming machine configured for communication with other gaming machines over a network, each gaming machine including a processor and memory storing programming to manage the operation of one or more wagering games and a display, the gaming machine comprising:

a memory storing, for each of at least two wagering games, configuration data including wagering denomination and data representing the pay table and odds to jackpot;

a credit meter and bill/voucher acceptor for accepting and validating physical instruments to establish credits at the credit meter for the play of the wagering game;

the gaming machine processor and memory are configured to play any one of the two or more wagering game configurations a portable security device configured to be associated with the gaming machine processor to authorize a progressive jackpot controller to host a plurality of different progressive jackpots;

the progressive jackpot controller, when authorized, configured to (i) issue a request to the networked gaming machines to each report game configuration data for a wagering game resident on the gaming machine, (ii) determine which game configurations are compatible with at least one progressive jackpot and (iii) control the display to identify each game configuration that is compatible with each progressive jackpot; and an input device at one or each gaming machine to select to associate a compatible wagering game configuration to a compatible progressive jackpot.

3. The gaming machine of claim 2 wherein the security device is a portable memory device having a USB connection to said gaming machine.

4. The gaming machine of claim 2 comprising said security device when connected is in communication with said processor.

5. A system for configuring progressive jackpots comprising:

a plurality of gaming machines connected by a network and configured to play two or more wagering games having different configuration attributes and each having a processor and memory storing data representing the configuration attribute including wager denomination and pay table data of each wagering game, a credit meter and bill/voucher acceptor for accepting and validating physical instruments to establish credits at the credit meter for the play of the wagering game;

a portable security device configured to authorize a gaming machine including a progressive controller software module to act as a hosting progressive jackpot controller for a plurality of progressive jackpots;

the authorized gaming machine configured to communicate over said network to the gaming machines to access data corresponding to the game attributes, to determine for each game any progressive jackpot which would be compatible with the game attributes, to control the display for each communicating gaming machine to display one or more compatible progressive jackpot associations for selection of association of the games with compatible progressive jackpots and to receive from an input device a selection of a compatible progressive jackpot.

6. The apparatus of claim 5 wherein the portable security device is a USB enabled device.

* * * * *